United States Patent [19]

Lee

[11] 4,274,374

[45] Jun. 23, 1981

[54] AIR-COOLED ROTARY INTERNAL COMBUSTION ENGINE

[76] Inventor: Choong G. Lee, 1943 Vancouver Dr., Honolulu, Hi. 96822

[21] Appl. No.: 2,367

[22] Filed: Jan. 10, 1979

[51] Int. Cl.[3] ..... F02B 53/00

[52] U.S. Cl. ..... 123/241; 418/61 R

[58] Field of Search ..... 123/241, 242, 246; 418/54, 58, 61 R, 101, 118, 161, 164, 165, 175, 209, 225

[56] References Cited

U.S. PATENT DOCUMENTS

| | | | |
|---|---|---|---|
| 840,688 | 1/1907 | Carpenter | 418/118 X |
| 949,605 | 2/1910 | Taylor | 418/165 |
| 2,478,924 | 8/1949 | Johnson | 123/241 |
| 3,241,745 | 3/1966 | Williams | 418/61 R |
| 3,302,623 | 2/1967 | Zimmerman | 418/101 |
| 3,865,086 | 2/1975 | Lee | 123/241 |

FOREIGN PATENT DOCUMENTS

| | | | |
|---|---|---|---|
| 900028 | 12/1953 | Fed. Rep. of Germany | 123/246 |
| 1293784 | 4/1969 | Fed. Rep. of Germany | 123/241 |
| 474772 | 12/1914 | France | 123/246 |
| 606687 | 3/1926 | France | 418/225 |
| 145149 | 6/1920 | United Kingdom | 123/246 |

*Primary Examiner*—Michael Koczo, Jr.
*Attorney, Agent, or Firm*—Stephen F. K. Yee

[57] ABSTRACT

A rotor chamber and cooperating lubricant passages are defined within an engine housing having a plurality of heat-transfer fins on the exterior surface thereof. A rotor having fluid passages therein is rotatably disposed within the chamber on a shaft, and a pair of lever wheels is rotatably supported within recessed chambers provided in the rotor. Rotatable combustion chambers are defined between adjacent lever arms, and the end of each lever arm engages arm-receiving recesses disposed about the rotor chamber periphery. Cooling and exhaust fans are coaxially supported on the rotor shaft to draw cooling air over the engine casing and to extract exhaust gases from the engine, respectively. The tip and sides of each lever arm are provided with pivotal sealing elements biased into contact with the surfaces of the recessed chambers to provide sealing forces proportional to the pressure of the combustion gases.

10 Claims, 11 Drawing Figures

AIR-COOLED ROTARY INTERNAL COMBUSTION ENGINE

BACKGROUND OF THE INVENTION

The invention relates generally to internal combustion engines, and more particularly to air-cooled rotary internal combustion engines.

Rotary internal combustion engines, or rotary engines, are attractive because of their high theoretical efficiency and simplicity of construction and operation. Their relatively high power output and compact size make them particularly attractive for utilization in applications in which size and weight are prime considerations.

In the applicant's U.S. Pat. No. 3,865,086, issued Feb. 11, 1975, an improved and simplified rotary internal combustion engine is disclosed in which the power of internal combustion is converted to a lever force acting upon an output axis by means of levers revolving about a second axis which is displaced from the output axis, thus permitting the direct application of torque to the output axis. The disclosure of this patent is fully incorporated herein by reference.

The compact size and lightweight of the rotary engine can be further enhanced by the use of air-cooling in place of the bulkier and heavier closed, recirculating coolant system. Air-cooling of internal combustion engines is known in the art. For example, in U.S. Pat. No. 2,209,996, issued Aug. 6, 1940 to A. H. Neuland, an internal combustion engine is provided with a fan and cooling ducts to direct air flow over the piston, spark plugs and oil cooler, and to mix the cooling air with the exhaust gases before the mixture is discharged from the engine. Other examples of air-cooled internal combustion engines are disclosed in U.S. Pat. Nos. 1,485,591, 2,020,089, 2,288,018, 2,369,002 and 3,911,876.

The problem of short service life of the sealing elements in a rotary engine, particularly the tip or apex sealing elements provided between the rotor and the rotor chamber, has received considerable attention recently. Factors which contribute to the short life of the apex seal include high rotational speed of the rotor, the high friction associated with this high speed, and the requirement to provide continuous and effective fluid seal as the seal is rotating. In addition to the requirement for sealing between the tips of the rotor and the rotor housing, the rotary engine also requires sealing between the sides of the rotor and the rotor chamber, which is usually provided by the side seals.

Many different solutions have been proposed for the problem associated with the tip or apex seals. For example, one type of such seal includes a sealing blade or element which is pivotally carried on the rotor, and is biased into sealing contact with the rotor chamber by the force of the combustion gases. This type of sealing offers the advantage that as the pressure of the gases increases, the amount of sealing force provided increases proportionally. Examples of such sealing elements may be found in U.S. Pat. Nos. 1,004,776, 1,406,140 and 3,891,359. The requirement for providing a fluid seal between the sides of the rotor and the sides of the rotor chamber have not been as critical and have generally been met by the provision of annular fluid seals in the walls of the rotor chamber.

SUMMARY OF THE INVENTION

It is a general object of the present invention to provide in the applicant's improved and simplified rotary internal combustion engine, as disclosed in U.S. Pat. No. 3,865,086, an improved and efficient means for air-cooling the engine and improved fluid sealing between the rotary elements of the engine rotor and the surfaces of the rotor chamber. Other objects of the invention include: improvements in the flow of the fuel and gases through the engine to improve its operation and increase its effectiveness; circulation of lubricating-cooling oil through the engine to lubricate and to augment cooling of the engine; and the provision of an improved air-cooled rotary engine which is compact, simple and efficient.

These and other objects are achieved by providing in a rotary engine a housing defining a rotor chamber having a plurality of radially-extending smaller chambers or recesses equally spaced along the periphery of the rotor chamber. Rotatably disposed within the chamber is a rotor supporting a pair of lever wheels or spider assemblies, each of which is rotatably supported within a circular recess or spider chamber in the rotor. The end of each radial arm of the spider assemblies is adapted to sealingly engage the recesses disposed around the periphery of the rotor chamber, and a tip seal is provided for this end which cooperates with the circumferential wall of the rotor chamber to provide an effective fluid seal in which the sealing pressure increases proportionally with the pressure increase of the combustion gases. The sides of each spider arm are provided with pivotal sealing elements which cooperate with the sides of the rotor chamber to provide an effective fluid seal in which the sealing pressure increases proportionally with increases in the pressure of the combustion gases. A valve in each of the spider chambers cooperates with the rotating spider assembly to prevent the direct exhaust of the fuel. Additional sealing elements are provided along the circumference of the rotor chamber.

Combustion chambers are defined by the volume encompassed by two adjacent arms of the spider assembly and the opposite portions of the sidewalls of the rotor chamber. During combustion, each spider assembly pivots about the end of the arm engaging the radially-extending recesses, and the lever force thus produced acts upon the displaced rotational axis of the spider assembly to provide a resultant torque about the central output axis of the rotor.

BRIEF DESCRIPTION OF THE DRAWINGS

The above description, as well as further objects, features, and advantages of the present invention will be more fully appreciated by reference to the following description of a presently-preferred but nonetheless illustrative embodiment in accordance with the present invention, when taken in connection with the accompanying drawings, wherein.

DESCRIPTION OF THE PREFERRED EMBODIMENT

Figure 1:
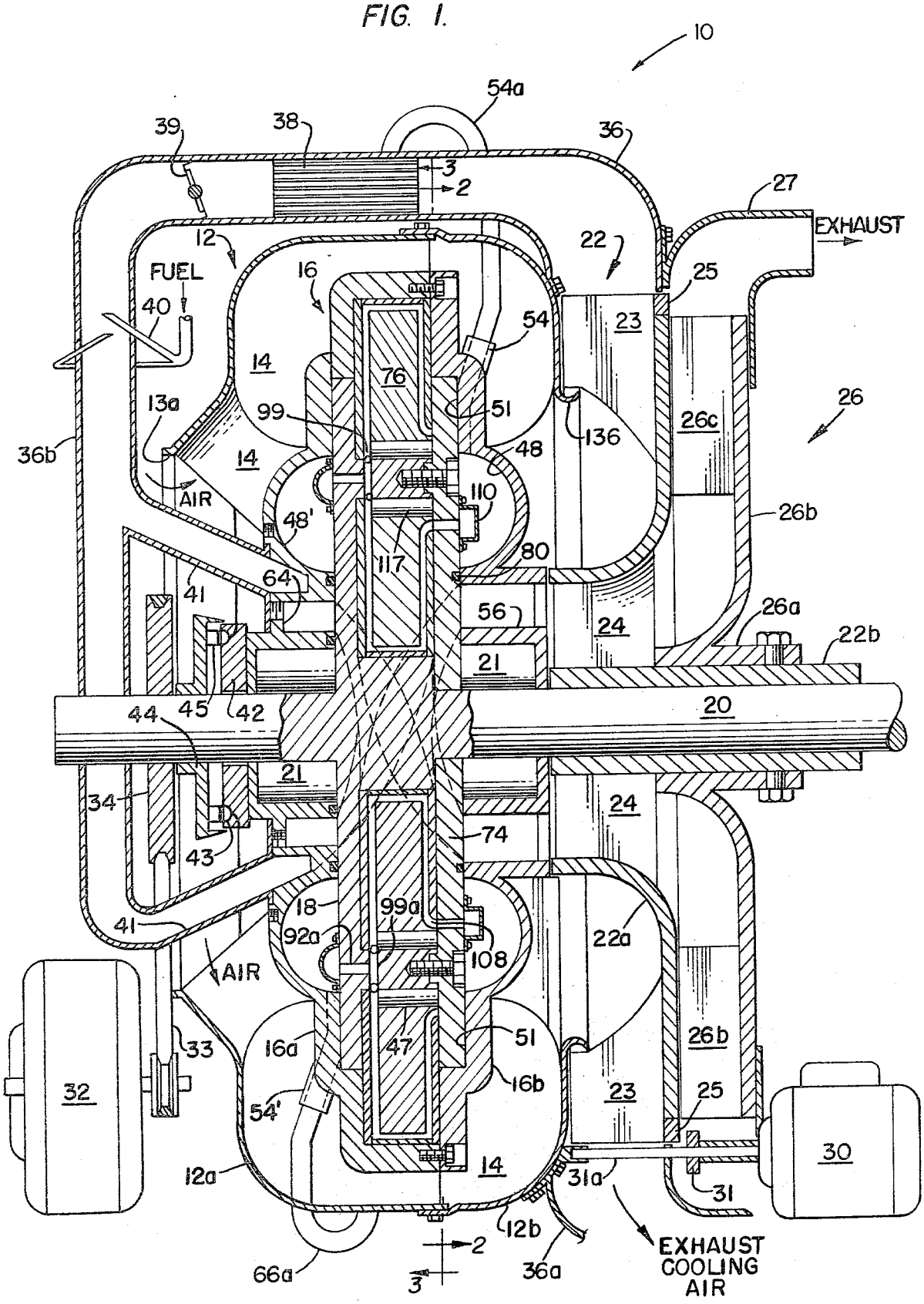
FIG. 1 is an elevational view, with some of the structure shown in section, of the engine of the present invention.

Referring more particularly to FIG. 1 of the drawings, 10 generally designates the air-cooled, rotary, internal combustion engine or rotary engine of the present invention, which includes an engine shroud 12 having a front portion 12*a* and a back portion 12*b* appropriately joined together at their mating end surfaces, with the other end surfaces of the shroud portions having circular openings 13*a* and 13*b*, respectively. The engine shroud 12 encloses a plurality of heat transfer or cooling fins 14 disposed on an engine casing or housing 16 in a substantially parallel manner to define a plurality of flow passages through which the cooling air drawn through the opening 13*a* passes, to be discharged through the opening 13*b*. The cooling fins 14 are attached to the outer surface of the engine casing 16 in a heat-exchange manner to improve the removal of heat from the engine during its operation. The engine casing 16 may be conveniently formed in unequal halves, as seen in FIG. 1, with a front section 16*a* and a back section 16*b* being appropriately joined to form a cylindrical, rotor-receiving chamber 17, as will be described below with respect to FIGS. 2 and 3.

A circular, disk-shaped rotor 18 is disposed within the chamber 17 and is mounted for rotation on a rotor shaft 20 which extends through the engine casing sections 16*a*, 16*b* and the circular openings 13*a*, *b*. The rotor shaft 20 is rigidly connected to the rotor 18, and is journalled in bearings 21 disposed on the engine casing 16 to permit rotation of the rotor and the shaft, and forms the output drive shaft of the engine 10.

A cooling fan 22 having a body 22*a* to which is attached a plurality of arcuate vanes or blades 23 is disposed downstream of the opening 13*b*, and is rotatably supported coaxially upon rotor shaft 20 by a central sleeve 22*b*. The body 22*a* of the cooling fan 22 resembles a concave, circular disc having a central opening through which the rotor shaft 20 extends. A plurality of radially-extending struts 24 interconnects the fan body 22*a* and the sleeve 22*b* to form an open, axially-extending passage to permit the flow of exhaust gases from the engine. A flywheel 25 in a form of a ring is attached to the periphery of the cooling fan body 22*a*, and functions as a conventional flywheel.

Disposed directly behind the cooling fan 23 is an exhaust fan 26 having a central collar 26*a* attached coaxially onto the sleeve 22*b* of the cooling fan to permit simultaneous rotation of both fans. The exhaust fan 26 has a disk-shaped body 26*b* on which are secured a plurality of curved vanes 26*c* which, during the operation of the engine, draw the exhaust gases from the engine through the axial passage defined in the central portion of the cooling fan 22, as noted above, and discharges the exhaust gases into the atmosphere through an exhaust conduit 27.

A starter motor 30 operates to start the engine 10 by the controlled engagement of a gear 31 with the flywheel 25, the gear being slidably mounted on a shaft 31*a* extending between the motor and the engine. Suitably supported at the front end of the engine 10 is a conventional electrical generator 32 which is coupled by a belt 33 to a pulley 34 attached to the rotor shaft 20 for rotation therewith. Other components of the electrical system customarily associated with an internal combustion engine, such as a storage battery, voltage regulator, etc., are not shown in the drawings, but it is understood that they would be incorporated into an operating engine installation.

Figure 4:
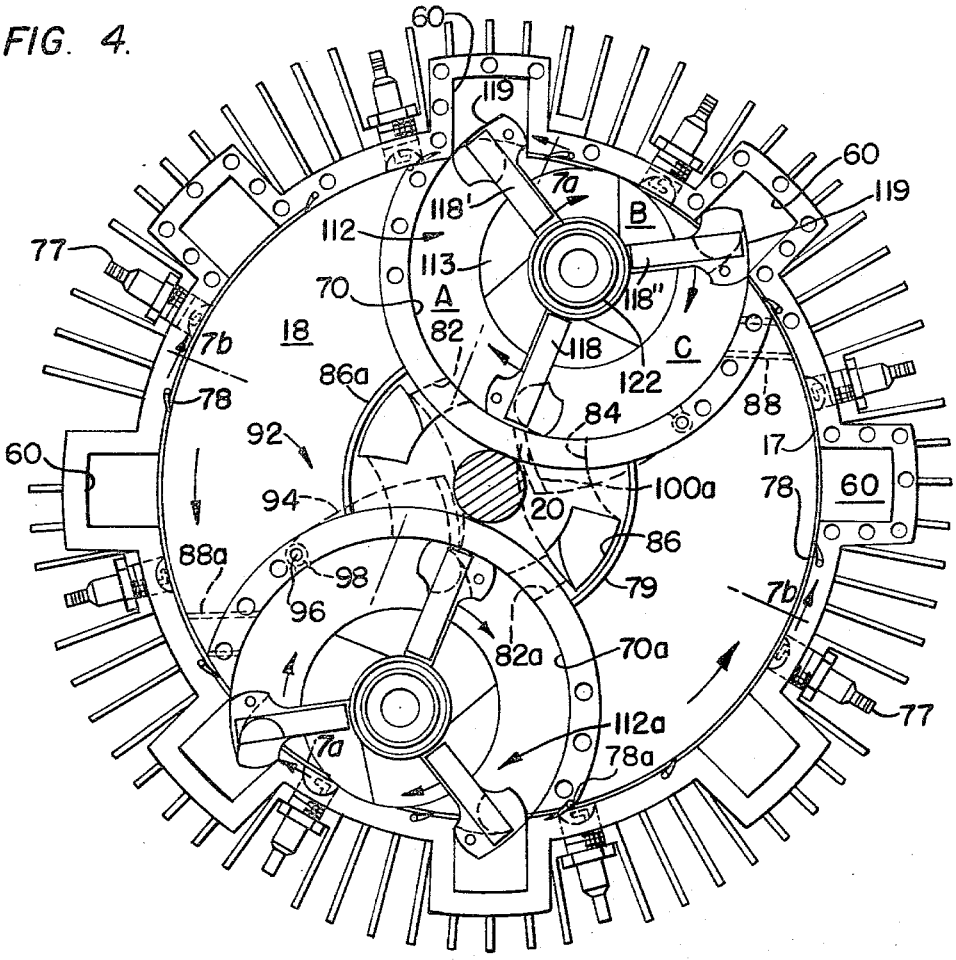
FIG. 4 is a view similar to FIG. 3, showing some of the internal components of the engine.

Part of the cooling air drawn through the engine shroud 12 by the cooling fan 22 is directed through an air duct 36 to a filter 38, and the remaining cooling air is discharged to the atmosphere through an exhaust duct 36*a*. Filtered air is directed by a control valve 39 to a manifold portion 36*b* of the air duct 36 to be mixed with fuel introduced by an injector 40 which is connected in a suitable manner to a source of fuel. The resulting fuel-air mixture is introduced via conduits 41 into suitable ports provided in the engine casing 16. p Components of the electrical control system for igniting the fuel-air mixture in the engine 10 are shown in FIG. 1, and include a circular member 42 which is fixed to the engine casing 16 and remains stationary. The circular member 42 functions in the same manner as a distributor in a conventional reciprocating internal combustion engine, and for the sake of convenience will hereinafter be referred to as a distributor. A number of electrical contacts 43 are equally spaced adjacent the periphery of the distributor 42, and are electrically connected to spark plugs (FIG. 4). Attached to and rotatable with the rotor shaft 20 is a distributor rotor 44 which is spaced apart and positioned parallel to the distributor 42, and is provided with a number of electrical contacts 45 equally spaced adjacent to the periphery, at the same radial distance from the axis of the rotor shaft 20 as the contacts 43 provided on the distributor. While not specifically shown in the drawings, it is understood that the electrical contacts 45 on the distributor rotor 44 are appropriately connected to the source of electrical energy such that in cooperation with the contacts 43 on the distributor, they function to energize the spark plugs at the appropriate times.

Engine Casing

Figure 2:
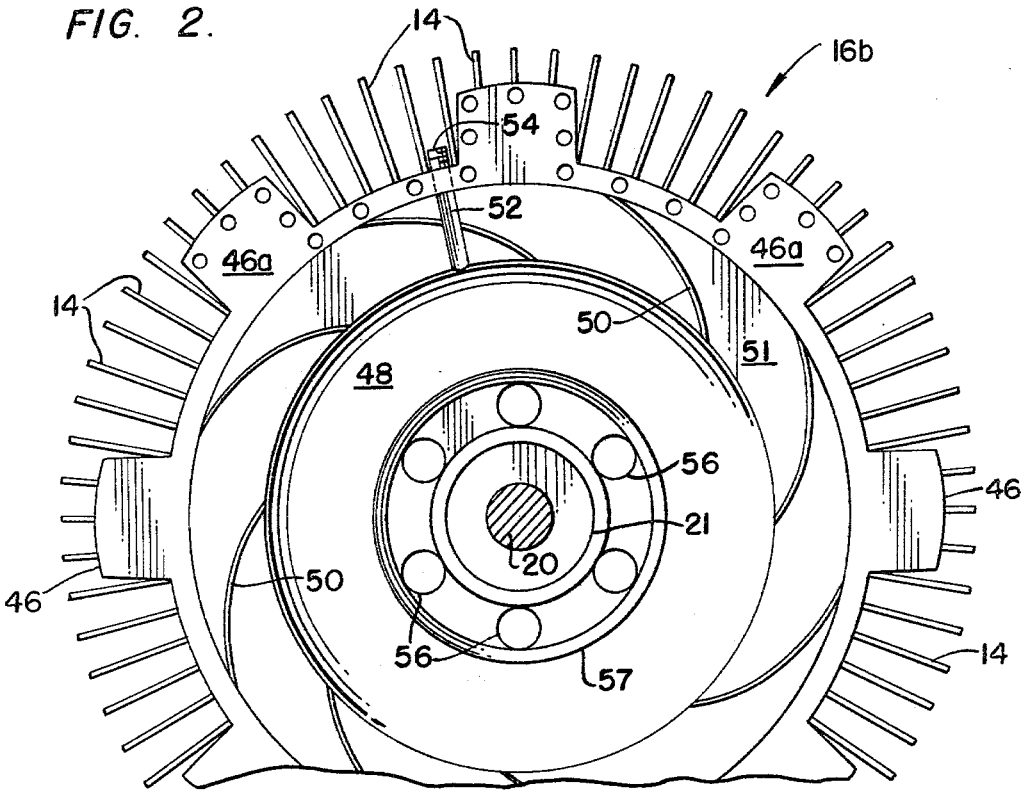
FIG. 2 is a cross-sectional view as seen along line 2—2 in FIG. 1, with some of the structure removed for clarity.
Figure 3:
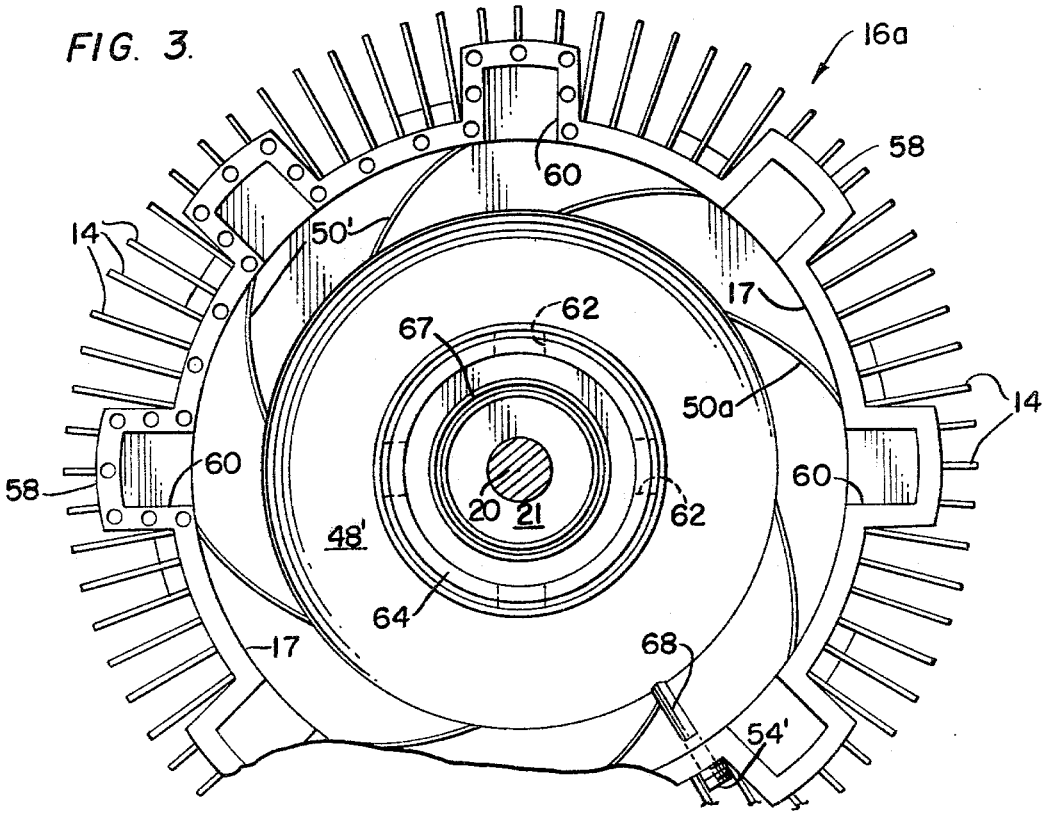
FIG. 3 is a cross-sectional view as seen along line 3—3 in FIG. 1, with some of the structure removed for clarity.

The internal structure of the engine casing sections 16*b* and 16*a* are shown more particularly in FIGS. 2 and 3, respectively, in which the rotor 18 and other associated components have been removed to enhance the clarity of the drawings. A number of radially-extending projections 46 are equally spaced on the periphery of the casing section 16*b*, and have planar surfaces 46*a* which form the closure surfaces for the corresponding recesses on the front casing section 16*a*, as will be described more fully below. The cooling fins 14 provided on the exterior surface of the casing section 16*b* and on the projections 46 are clearly shown in FIG. 2.

An oil channel 48 in the form of an annular, concave groove is provided in the casing section 16*b*. Disposed radially outward of the oil channel 48 are curved, shallow grooves 50 provided on a planar portion 51 of the casing section 16*b*, which aid the circulation of the lubricating-cooling oil. An oil outlet 52 extends radially between the oil channel 48 and an oil outlet coupling 54 extending from the exterior surface of the casing section 16*b*, which in turn is connected to an oil pipe (not shown in FIG. 2) for circulation of the oil. Located radially inward of the oil channel 48 is a series of axially-extending exhaust apertures 56 equally spaced in a circular arrangement through which the exhaust gases are sucked from the engine by the exhaust fan 26. The rotor shaft bearing 21 is disposed between the exhaust ports 56 and the rotor shaft 20 extending axially through the central aperture of the engine casing section 16*b*, and an annular seal 57 prevents leakage of the oil from the channel 48.

The front engine casing section 16*a* shown in FIG. 3 includes a number of radially-extending elements 58 equally spaced about the peripheral surface, each of the elements defining a recess or receiving chamber 60 therein for receiving the enlarged head portion of the spider elements, as will be described more fully below. The walls of the elements 58 are provided with tapped holes for receiving suitable fasteners which join the front and back sections of the engine casing 16. The cooling fins 14, the rotor shaft 20, shaft bearing 21, shallow grooves 50' and the annular oil channel 48' are structurally and functionally similar to the corresponding elements shown in FIG. 2 and described with respect to the back engine casing section 16*b*. A number of radially-extending inlets 62 in fluid communication with the fuel-air conduits 41 are provided for the introduction of the fuel-air mixture into an annular fuel-air channel 64 which is functionally the equivalent of a intake manifold in a conventional internal combustion engine. The fuel-air channel 64 is positioned radially inward of the oil channel 48', and is separated therefrom by a sealing ring 66 disposed within an annular groove. The fuel-air channel 64 is separated from the shaft bearing 21 by a second sealing ring 67 which is disposed adjacent to the inner periphery of the channel. Oil introduced through the coupling 54' is discharged into the oil channel 48' via the radially-extending oil inlet 68. The inner cylindrical surface of the casing section 16*a*, in cooperation with the section 16*b*, defines the rotor chamber 17.

Rotor

The structure of the rotor 18 and the components associated therewith will be described with references to FIGS. 4, 5, 6 and 7*a*, *b*. The rotor 18 and the shaft 20 securely attached thereto are disposed for rotation relative to the engine casing 16 by the rotor shaft bearings 21 suitably supported by the engine casing. The rotor 18 is received within the rotor chamber 17 with nominal clearances which permit free rotation of the rotor. The clearance between the periphery of the rotor 18 and the inner surface of the chamber 17 has been exaggerated in FIG. 4 to show the sealing elements which will be described more fully below.

A pair of equal-diameter circular recesses or spider chambers 70 and 70*a* is formed in one face of the rotor 18. Since the structure of the chambers 70, 70*a* are identical, only chamber 70 will be described, with the corresponding structures in the chamber 70*a* being identified in the drawings with the suffix "a". Disposed at the center of the chamber 70 is a spider support shaft 71 having a tapped hole for receiving a fastener securing a cover to the chamber. The centerline of the support shafts 71, 71*a* lie on a common diameter extending through the centerline of the rotor shaft 20, but the axis of each support shaft is offset with respect to the rotor shaft axis. The shaft 71 is provided with radially-extending bores 72 which connect with a circumferential groove 73 adjacent to the base of the shaft for the circulation of oil into the spider assembly, as will be described below.

The periphery of the spider chamber 70 is provided with a stepped protion 74 for receiving a cover 76 which closes the chamber. The cover 76 is provided with holes spaced around its periphery which align with corresponding tapped holes in the stepped portion 74 to receive suitable fasteners for the cover. Visible in FIG. 4 are the spark plugs 77, the rotor chamber seal elements 78 disposed between the periphery of the rotor 18 and the wall of the chamber 17, and a groove 79 on the surface of the rotor to receive a fluid seal 80 shown in FIG. 1.

Figure 5:
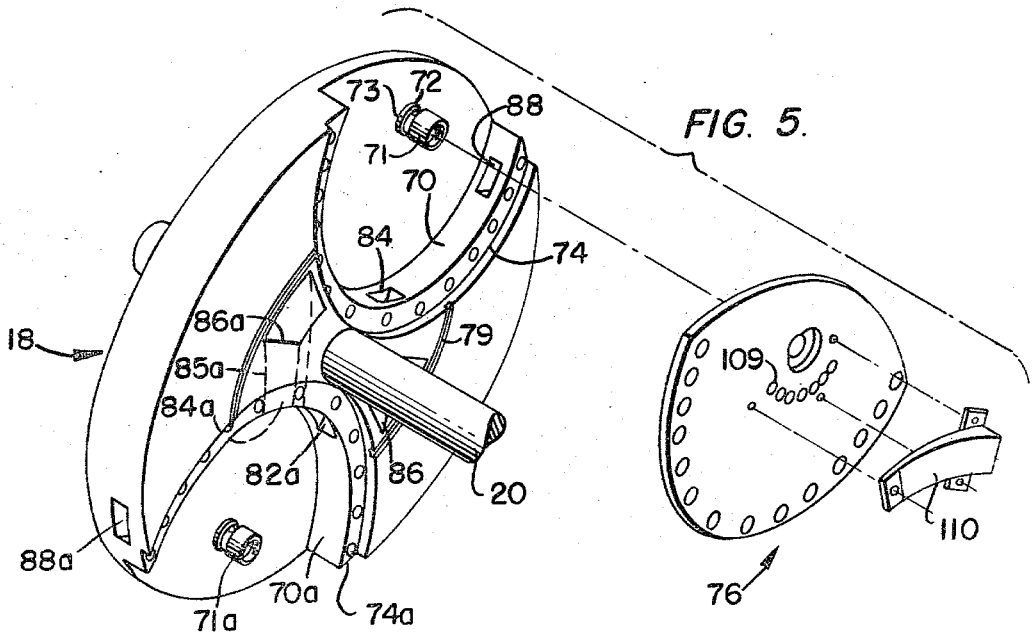
FIG. 5 is an exploded, perspective view of the engine rotor.
Figure 7A:
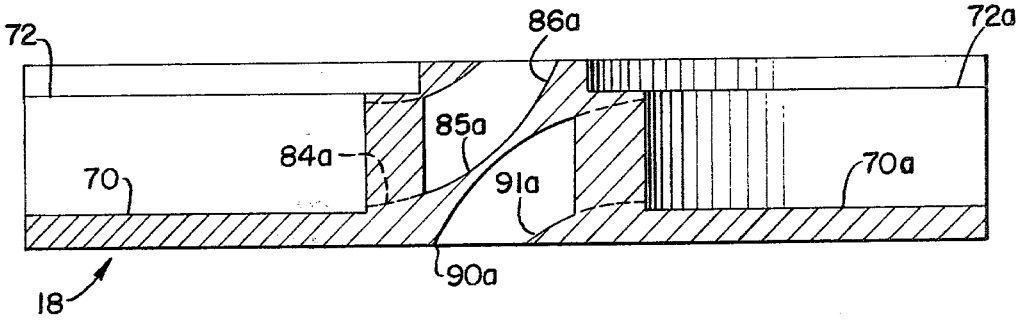
FIGS. 7*a* and 7*b* are sectional views as seen along lines 7A—7A and 7B—7B, respectively, in FIG. 4.

The spider chamber 70 has a fuel-air outlet 82 and an exhaust port 84 which open into the cylindrical sidewall of the chamber, and are properly spaced to introduce the fuel-air mixture into the rotating combustion chamber defined between adjacent levers of the spider assembly, as described below, and to exhaust the combustion gases. The exhaust port 84 is connected by an exhaust passage 85 to an exhaust opening 86 in one face of the rotor 18, adjacent to the groove 79 (FIGS. 5 and 7*a*). As shown in FIG. 5, the exhaust openings 86, 86*a* of the respective spider chambers 70, 70*a* are disposed on diametrically opposite sides with respect to the rotor shaft 20. As noted above, and as can be seen from FIG. 1, the exhaust openings 86, 86*a* periodically register with the circular exhaust apertures 56 provided in the back engine casing section 16*b*.

Shown in dotted lines in FIG. 4 are exhaust orifices 88, 89*a* extending between the chambers 70, 70*a* and the peripheral edge of the rotor 18 which permit the removal of the unburned portion of the fuel-air mixture isolated in the spider chambers by rotation of the rotor during operation of the engine.

Figure 6:
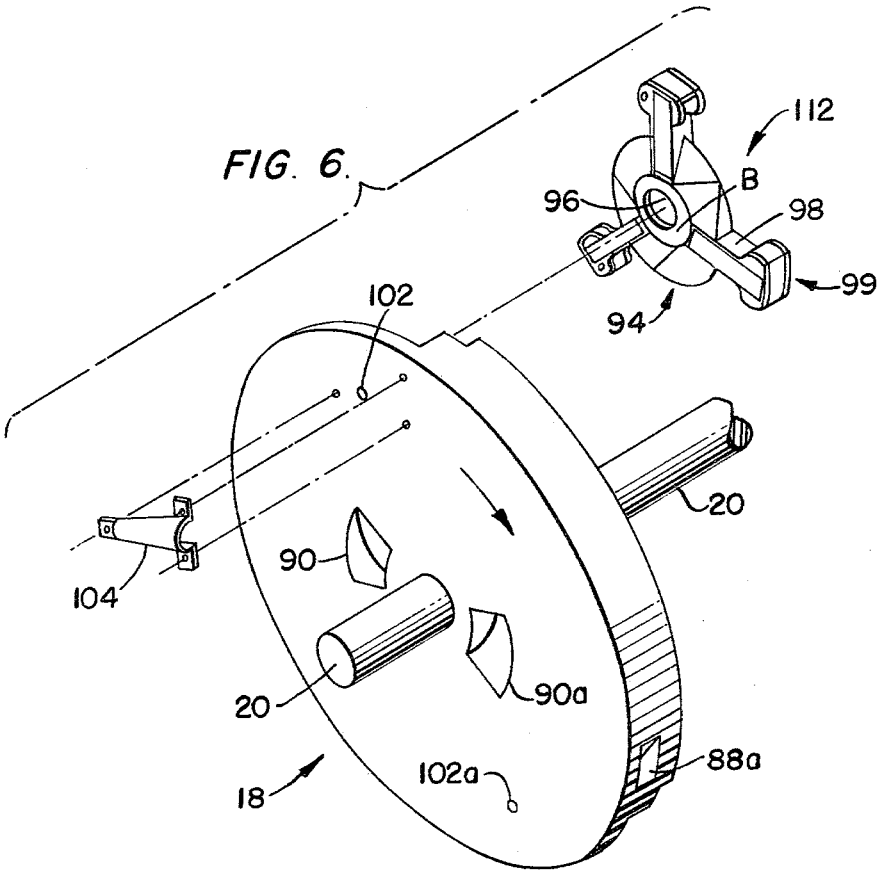
FIG. 6 is a view similar to FIG. 5, showing the other side of the engine rotor.
Figure 7B:
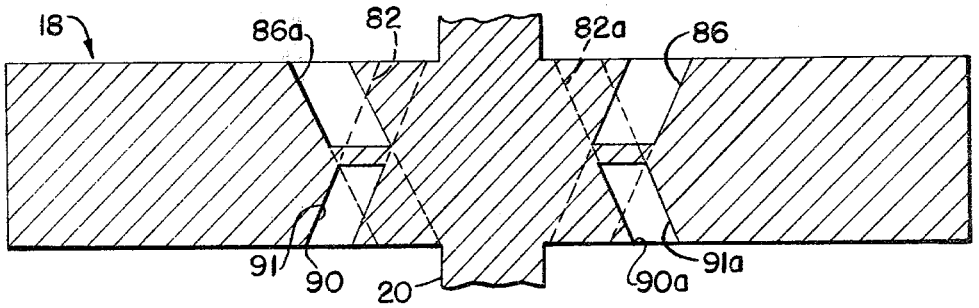

Visible in FIG. 6 are fuel-air intakes 90, 90*a*, or fuel intakes, defined by orifices or opening in the surface of the rotor 18 which faces the forward portion of the engine 10 (to the left in FIG. 1), i.e., the rotor surface opposite the spider chambers 70, 70*a*. The fuel intakes 90, 90*a* lie on a common diameter, on opposite sides of the axis of the rotor shaft 20, and as shown in FIG. 1 are in fluid communication with the fuel-air manifold 64 provided in the engine casing section 16*a*. Fuel-air passages 91, 91*a* (FIGS. 7*a*, 7*b*) extend from the fuel intakes 90, 90*a* in a curved fashion through the thickness of the rotor 18, and terminate in the respective fuel-air outlets 82, 82*a* provided in the sidewalls of the rotor chambers 70, 70*a*.

Since the fuel intakes 90, 90*a* are always in communication with the fuel manifold 64, a valve 92 is provided in each spider chamber 70, 70*a* to prevent the flow of the fuel-air mixture from the fuel-air outlets 82, 82*a* directly to the exhaust ports 84, 84*a* when the spider arms are not in position to separate the fuel-air inlets from the exhaust ports. Valve 92 may be in the form of a spring-biased curved plate 94 supported at one end by a pivot 96 on the stepped portion 74 of the spider chamber 70 (FIG. 4). The curved plate 94 is of sufficient length to cover the exhaust port 84 in the closed position, and is biased into this position by a spring 98 supported on the pivot 96. A curved tip 100 at the free end of the plate 94 may be in the form of a rectangular element with a height equal to the depth of the spider chamber 70, and a length sufficient to extend between the curved sidewall of the chamber and the periphery of the spider hub (described below).

In this manner, when the curved tip 100 is biased into the closed position, it serves to separate the volume in which the exhaust gases are confined from the volume in which the fuel-air mixture is introduced into the combustion chamber, thereby preventing direct exhaust of the fuel-air mixture. The tip 100 of the valve 92 is forced open against the force of the spring 98 by the spider arm during rotation, permitting exhaust of the combustion gases.

The rotor 18 is provided with diametrically-positioned oil ports 102, 102*a* (FIG. 6), each of which is coaxial with the centerline of the spider shaft 71. As shown in FIG. 1, the oil ports 102, 102*a* extend through the thickness of the rotor 18 and terminate in the radial bores 72, 72*a* provided in the spider shafts 71, 71*a*, respectively, which in turn are in fluid communication with the circumferential grooves 73, 73*a*. The oil ports 102, 102*a* are in fluid communication with the oil channel 48*a* provided in the engine casing section 16*a*. To insure that a sufficient quantity of oil passes through the oil ports 102, 102*a* as the rotor 18 rotates in the direction indicated by the arrow in FIG. 6, guides 104, one of which is shown in FIG. 6, in the form of an elongated cover is attached to the rotor surface and extends over the oil ports 102, 102*a*. Guides 104 extend from the surface of the rotor 18 into the oil channel 48*a* such that when the rotor 18 is in operation, the guides tend to scoop a quantity of oil therein and direct it through the oil ports 102, 102*a*.

On the other side of the rotor 18 the annular oil groove 108 (FIG. 1) provided on the surface of the spider hub is in fluid communication with a series of holes 109 arranged in a circular arc on the cover plate 76 (FIG. 5). Positioned over the holes 109 is an oil deflector 110 which diverts the oil issuing from the holes circumferentially into the oil channel 48 provided in the back engine housing section 16*b*.

Fuel and Exhaust Flow

The flow of the fuel-air mixture and the combustion gases to and from the engine 10 are evident from the foregoing-described structures. Briefly, the fuel-air mixture is introduced into the fuel manifold 64 by the fuel-air conduits 41. From the manifold 64, the fuel-air mixture flows into the fuel intakes 90, 90*a* through the fuel-air passages 91, 91*a* in the rotor 18, and is introduced into the respective spider chambers 70, 70*a* through the fuel-air outlets 82, 82*a*. This fuel-air mixture is subsequently compressed and ignited, and the resulting combustion gases expanded, as will be described below with respect to the operation of the engine.

The separation valves 92, 92*a* divide adjacent combustion in the spider chambers 70, 70*a* to prevent the incoming fuel-air mixture flowing directly to the exhaust ports 84, 84*a* when one of the levers or arms of the spider assembly is not in the space between the fuel-air outlets 82, 82*a* and the exhaust ports 84, 84*a*, as described above.

Under the combined sweeping action of the rotating lever arms of the spider assembly and the suction created by the exhaust fan 26, the combustion gases are extracted from the spider chambers 70, 70*a* via the exhaust ports 84, 84*a* and are discharged from the engine through the exhaust apertures 56 in the back engine casing section 16*b*. The combustion gases subsequently flow axially through the central passage surrounding the sleeve 22*b* of the cooling fan 22, and are discharged by the exhaust fan 26 through the exhaust conduit 27, as noted previously.

Spider Assembly

Lever wheels or spider assemblies 112, 112*a* are rotationally received on the shafts 71, 71*a* within the spider chambers 70, 70*a*, respectively. Since both spider assemblies are the same structurally, the following description of the spider assembly 112 will be applicable to both.

Figure 8:
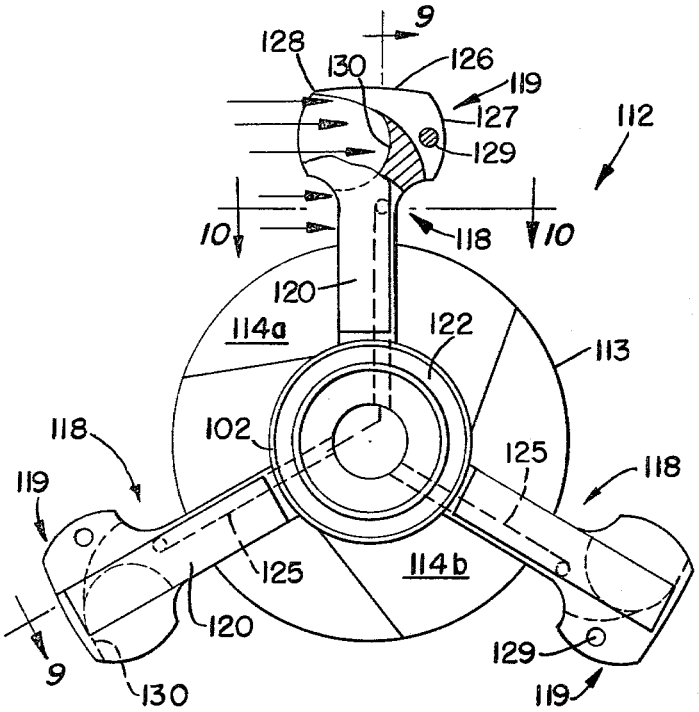
FIG. 8 is a elevational view of one of the lever wheels or spider assemblies of the present engine, showing the forces acting on one lever element of the spider assembly.

As shown in FIGS. 4, 6 and 8, the illustrated embodiment of the spider assembly 112 includes a central hub 113 which defines a plurality of inclined planar compression surfaces, such as those indicated at 114*a*, *b*, which help in the compression of the fuel-air mixture and direct the gases toward the sealing elements during the combustion process, as described more fully below. The hub 113 is provided with a central bore 116 which receives the roller bearings 117 and fits over the shaft 71 when the spider assembly 112 is properly positioned within the spider chamber 70, as shown more particularly in FIG. 1. Extending radially from the hub 113 are levers or arms 118, three in the illustrated embodiment, or any other appropriate number, with each of the levers terminating in an enlarged head portion 119. Each lateral surface of each lever 118 is provided with a side sealing element 120 which is pivotally attached to the lever and which normally lies flush with the surface.

Figure 9:
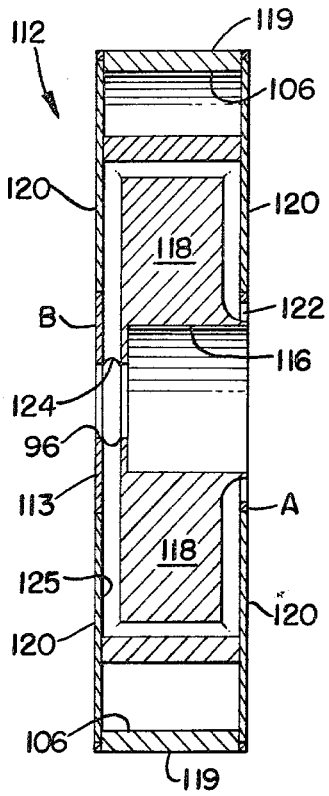
FIG. 9 is a sectional view as seen along line 9—9 in FIG. 8.

One surface A of the hub 113, i.e., the surface which is adjacent to the spider chamber cover 76 when the engine 10 is assembled, is provided with an annular oil groove 122 (FIGS. 4 and 8). The other surface B of the hub 106 is provided with a recessed annular groove 124 (FIG. 9) which, with the spider assembly properly positioned on the shaft 71, is in fluid communication with the circumferential oil groove 73 provided on the surface of the shaft. As was noted above, the groove 73 in turn is in fluid communication with bores 72 extending radially from the central axis of the shaft 71.

Each of the spider levers 119 is provided interiorly with an oil channel 125 extending radially along the sides of the lever which is in fluid communication at one end with the recessed groove 124 and at the other end with the annular oil groove 122 on the surface of the hub 113.

Oil Circulation

From the foregoing, the oil circulation path through the engine 10 is apparent. The oil circulating in the channel 48 provided in the engine casing section 16*b* flows radially outwardly through the oil outlet 52 and through the coupling 54 which is appropriately connected to an oil pipe 54*a* extending externally of the engine 10. While not specifically shown in the drawings, the oil pipe 54*a* directs the oil to an oil cooler which cools the heated oil, and a pump is provided to circulate the oil through the engine. The recirculating oil leaving the oil cooler is introduced into the oil inlet 68 in the front engine casing section 16*a* and into the oil channel 48' ( FIG. 3).

A portion of the oil in the channel 48'is directed by the guides 104, 104*a* through the oil ports 102, 102*a*, into the radial bores 72, 72*a* provided in the spider shafts 71, 71*a*, and into the grooves 73, 73*a* circumscribing the shafts adjacent to the bases thereof. The oil then flows through the channels 125, 125*a* extending along the spider levers 118, 118*a*, and is collected in the oil grooves 122, 122*a* on the spider hubs 113, 113*a*. From these grooves, the oil passes through the holes 109 in the cover plates 76, 76*a* and is directed circumferentially by the deflectors 110, 110*a* into the oil channel 48 in the back engine casing section 16*b* for recirculation in the manner described above.

Sealing Elements

In addition to the annular sealing rings described above which provide sealing between the circulating oil, the fuel-air mixture, and the combustion gases, other sealing elements are provided in the present engine which serve unique functions.

The side sealing elements 120 disposed on each side of the spider lever 118, have been described above. The enlarged head portion 119 of each lever 118 is provided with a tip seal 126 having a rounded leading portion 127 and a tapered trailing portion 128, and which is rotationally supported about a pivot 129 fixed to the lever. The downstream side of the enlarged head 119 is provided with a cavity or recess 130 defined by the marginal sides of the enlarged head and closed by the pivoted tip seal 126.

Figure 10:
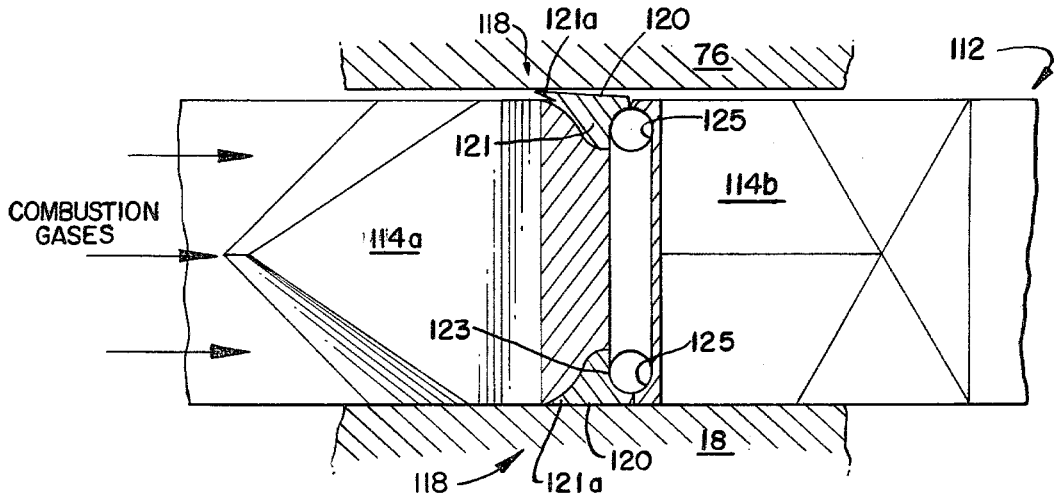
FIG. 10 is a fragmentary view as seen along line 10—10 in FIG. 8, with some of the structure shown in section, illustrating the operation of one of the side seals of the spider assembly.

The operation of the side sealing elements 120 and the tip seals 126 may be better understood with reference to the FIGS. 8 and 10. In FIG. 8, the arrows represent the force of the expanding combustion gases on the recess 130 provided in the enlarged head portion 119 of the spider levers 118. The pressure of the gases acting on the surfaces of the recess 130 rotates the spider assembly about the shaft 71, and also exerts a force on the pivoted tip seal 126, causing the tapered trailing portion 128 to rotate about the pivot 129. This rotation effects a tight fluid seal between the head of the spider lever 118 and the curved surfaces of the spider chamber 70, 70*a*, with the amount of sealing force being directly proportional to the pressure exerted upon the spider arm by the expanding combustion gases. Thus, as the pressure increases, the amount of sealing provided by the tip seal 126 increases in direct proportion therewith, so that as a greater sealing requirement is demanded by an increased operating pressure, a greater sealing force is provided.

Additionally, the pivotal movement of the tip seal 126 permits automatic adjustment and accommodation for wear on the tapered trailing portion 128 as this portion wears down with use, thereby improving the reliability and the longevity of the tip seals, and eliminating the requirement for frequent repairs and replacement which is necessary with some prior-art tip seals. The inclined planar surfaces 114*a*, 114*a* of the hub 113 direct the burning fuel-air mixture toward recess 130 to improve the efficiency of the tip seals 126, and improves the efficiency of conversion of the expanding gases to a spider-rotating force.

The side seals 120 which extend along the lateral surfaces of the lever arms 118 provide a fluid-tight seal between the lever arm and the sides of the spider chamber 70. The degree of sealing provided by the side seals 120 is directly proportional to the amount of force exerted on the lever arm 118 by the combustion gases. With reference to FIG. 10, the side seal 120 has an enlarged leading portion 121 which is rotatably attached to a pivot 123 positioned coaxially along the oil channel 125, with the tapered trailing edge 121*a* lying flush with the sides of the lever 119 when no forces are exerted on the seal. In FIG. 10, the gap between the spider arm 119 and the cover 76 for the spider chamber is an exaggeration of the clearance normally provided between these elements, to illustrate the operation of the side seal 120. During rotation of the spider assembly 112, movement is from left to right in FIG. 10, and the force of the combustion gases is directed to the right, as indicated by the arrows.

The inclined planar compression surfaces 114*a*, *b* provided on the spider hub 113 direct the combustion gases toward the recesses 130 and sides of the lever arms 119, to exert an outward force, i.e., up and down in FIG. 10, on the side seals 120, thereby forcing the tapered portions 121*a* of the seal against the surface of the cover plate 76 on one side, and against the side of the spider chamber 70 on the other side. As with the tip seal 126, the side seals 120 compensate for normal wear by being rotatable about their pivots 123, thereby insuring a fluid-tight seal for extended periods of operation before requiring refurbishment or replacement.

As shown in FIG. 4, tapered sealing elements 78 are supported on the engine casing section 16*a*, adjacent to the peripheral surface of the chamber 17, with their tapered, trailing edges biased into sealing contact with the peripheral surface of the rotor 18. The sealing elements 78 are circumferentially positioned on the chamber 17 to prevent the escape of fluid from the spider chambers 70, 70*a* when the spider assembles are in the firing positions as shown in FIG. 4. A tapered sealing element 78*a* is supported on the leading, or upstream, peripheral portion of each of the spider chambers 70, 70*a* to provide a fluid seal against the housing of the spark plug 77 which is not in firing registry with the spider chamber.

The sealing elements 78, 78*a* may be of any suitable material. For example, the sealing elements 78, 78*a* may be of a resilient material such as spring steel which will provide the sealing bias for the elements, and the contact edges may be of a durable material such as carbon steel. It is understood, of course, that instead of being of resilient material, each of the sealing elements 78, 78*a* may be pivotally mounted and spring biased for sealing contact with the rotor 18 and the interior surface of the chamber 17.

Operation of the Engine

The operations of the cooling fan 22 and the exhaust fan 26, the circulation of the lubricating-cooling oil through the engine, and the flow of the fuel-air mixture and combustion gases through the engine have been described above. Likewise, the operation of the tip seals 126 and the side sealing elements 120 have been fully described. The operation of the engine is fully described in the applicant's prior U.S. Pat. No. 3,865,086, which is incorporated by reference in the present application, and to which reference is now made.

By way of brief summary of the engine operation, the volumes defined between each adjacent pair of arms or levers 118 on the spider assemblies 112, 112*a* form three separate, rotating chambers which are sealed from each other by the aforesaid side and tip seals and the arms of the spider assemblies. This can be seen from FIG. 4 which shows the positions of the chambers at one instant of operation, and since the operation of the spider assemblies 112, 112*a* are identical, the following description for the assembly 112 is applicable to both. The three chambers are defined between the lever arms 118, 118' and 118". For convenience, the chamber between the levers 118 and 118' will be identified as chamber A; between levers 118' and 118" as chamber B; and between the arms 118" and 118 as chamber C. The volume of chambers A and C are equal, but the volume of chamber B is reduced and the fuel-air mixture therein has been fully compressed and is being ignited by the spark plug 77. The combustion cycle is exactly the same for each of the chambers A, B and C, except that they are out of phase with each other. Therefore, it will suffice to describe the cycle for the chamber A, although it will be appreciated that corresponding events are taking place at successively delayed times in chambers B and C.

In the chamber orientation shown in FIG. 4, the fuel-air mixture is being introduced into chamber A via the fuel-air outlet 82. In chamber B, the fuel-air mixture which is sealed within the chamber by the engagement of the enlarged head portion 119 of the adjacent arms 118',118" with adjacent chambers 60 and the side seals 120 on each of the lateral surfaces of the spider arms 118' and 118", has been compressed with the aid of the planar compression surfaces 114*a*, 114*b*. At the appropriate time, this mixture is ignited by the spark plug 77 by the electrical control system described above. In chamber C, the fuel-air mixture has been completely burned and fully expanded, and the tip of the spider arm 118 has pressed the curved tip 100 of the valve 92 into the open position, permitting the exhaust of the combustion gases through the exhaust port 84.

It is understood of course, that as the spider assembly 112 rotates, each of the chamber A, B, C will experience, in sequence, the operational sequence which are separately identified by the individual chambers A, B and C. Thus, the full charge of the fuel-air mixture in chamber A will experience progressive compression as the spider assembly 112 rotates clockwise, as indicated by the arrows, causing the chamber A to rotate therewith. At the proper phase, chamber A then occupies the position shown in FIG. 4 as chamber B, and the fuel-air mixture therein is fully compressed and ignited at the proper time by the spark plug 77. The force of the expanding, burning mixture tends to pivot the spider assembly 112 about the point of contact of the lever 118" with its corresponding lever head chamber 60, with the resultant torque being applied to the rotor 18 to cause rotation thereof about the shaft 20, in the direction indicated by the arrows in FIG. 4 which is counter to the rotation of the individual spider assemblies 112, 112*a*.

As the spider assembly 112 continues its rotation, chamber A occupies the same orientation as chambers C shown in FIG. 4, and the exhaust port 84 is opened to vent the combustion gases from the chamber. The hot, spent gases in the chamber, being at a much higher pressure than atmospheric, can be exhausted without further pressurizing the chamber. Additionally, the exhaust fan 26 draws the exhaust gases from the port 84, through the exhaust passage 85, and through the exhaust opening 86, from which the exhaust gases are sucked out through the exhaust apertures 56 in the engine casing section 16*b* and discharged through the exhaust conduit 27.

Those skilled in the art will recognize that many of the design aspects of the illustrated embodiment may be altered or combined with other features to accomplish various performance objectives without departing substantially from the principle and scope of the invention. For example, the relative diameters of the rotor 18 and the spider chambers 70, 70*a* can be varied. The shape of the spider arms 119 and the compression surfaces 114*a*, 114*b* forming the hub 113, 113*a* can be changed to increase or decrease the compression ratio. Any number of properly-sized and properly-designed spider assemblies may be provided on each rotor, and more than one rotor may be ganged on an output shaft to further increase the power of the engine. Additionally, while the specific engine illustrated herein operates on the two-cycle gasoline principle, the system is equally applicable with suitable modifications to two or four-cycle, gasoline, gas or diesel operation.

Although all of the components associated with an operating internal combustion engine have not been specifically described and illustrated, it is understood that such components are known and would be appropriately incorporated into the operative engine system.

Of course, variations of the specific construction and arrangement of the air-cooled rotary internal combustion engine disclosed above can be made by those skilled in the art without departing from the invention as defined in the appended claims.

I claim:

1. An air-cooled, rotary internal combustion engine, comprising:

a housing having a substantially circular interior chamber and a plurality of radially-extending recesses spaced along the periphery of said chamber;

a plurality of heat-transfer elements disposed on the exterior surface of said housing;

a rotor rotatably disposed within said chamber and having a substantially circular recess formed in one surface;

a lever assembly disposed within said circular recess and rotatable within said recess about an axis offset from the rotational axis of said rotor, said assembly having a plurality of radially-extending arms, the end of each arm engaging successive ones of said recesses during rotation of said lever assembly and said rotor;

a sealing element pivotally disposed on the end of each of said arms and engageable with the peripheral surface of said circular recess to provide a fluid seal;

a plurality of rotatable combustion chambers defined between adjacent arms of said lever assembly;

means for introducing a combustible mixture into the interior of said circular recess;

ignition means in said housing adjacent to each of said recesses for igniting said combustible mixture within the volume between two adjacent arms, the ends of said two adjacent arms simultaneously engaging consecutive recesses, whereby the force of combustion tends to pivot said lever assembly about the end of one of said arms in engagement with one of said recesses to drive the geometric axis of rotation of said lever assembly about the rotational axis of said rotor;

fan means coaxially disposed on the rotational axis of said rotor to draw air over the exterior surface of said housing and said heat transfer elements;

means including an exhaust blower coaxially disposed on the rotational axis of said rotor and said fan to remove exhaust gases from the interior of said circular recess; and means including flow-directing channels in said housing, said rotor and said lever assembly for circulating a lubricant through said engine.

2. The engine of claim 1, wherein said lubricant circulating means further includes :

a flow-directing channel in the wall of said interior chamber;

orifice means in said rotor for directing lubricant to said circular recess;

means on said rotor for diverting lubricant from said channel in said chamber to said orifice means in said rotor;

passage means in said lever assembly in fluid communication with said orifice means for circulating lubricant through each of said lever arms; and means in fluid communication with said passage means for returning lubricant to said channel in the wall of said interior chamber.

3. The engine of claim 1, further comprising another sealing element pivotally disposed on each side of each of said lever arms and engageable with the sides of said circular recess to provide a fluid seal.

4. The engine of claim 1, wherein said means for introducing a combustible mixture into the interior of said circular recess includes:

mixture distribution means in said housing;

flow passage in said rotor in fluid communication with said distribution means and the interior of said circular recess; and valve means controlled by said lever assembly to regulate the flow of said combustible mixture to the interior of said circular recess.

5. The engine of claim 1, wherein said means for removing exhaust gases from the interior of said circular recess further include:

an exhaust port in the circumferential surface of said circular recess;

an exhaust passage in said rotor, one end of said passage being in fluid communication with said exhaust port and the other end of said passage being in communication with an exhaust outlet on the circular surface of said rotor; and an exhaust aperture in said housing in fluid communication with said exhaust blower, said exhaust outlet in said rotor being periodically in fluid communication with said exhaust aperture during rotation of said rotor.

6. The engine of claim 1, wherein said circular recess includes:

inlet means in the circumferential surface of said recess for the introduction of the combustible mixture into the interior of said circular recess;

outlet means on the circumferential surface of said recess spaced from said inlet means for the removal of exhaust gases from the interior of said circular recess; and valve means controlled by rotation of said lever assembly for separating said inlet means and said outlet means.

7. The engine of claim 1, wherein said lever assembly is provided with a central hub defined by a plurality of inclined planar surfaces which are operative to divert the flow of the combustible mixture and the exhaust gases toward the sides and tip of each of said lever arms.

8. The engine of any of claims 1–7, wherein said circular recess is provided with a cover to define a closed volume within said recess extending between the rotor surfaces of said circular recess, said cover and a portion of said interior chamber.

9. The engine of any of claims 1–7, further including a shroud disposed about the exterior of said housing and said heat-transfer elements, said shroud having openings for the entry and exit of air to and from the interior of said shroud.

10. The engine of any of claims 1–7, further including a plurality of sealing means circumferentially spaced on said housing adjacent to the inner circumferential surface of said interior chamber to provide a fluid seal for said circular recess when the ignition means ignites the combustible mixture within the volume between two adjacent arms.

* * * * *